US011668023B1

(12) United States Patent
Truong

(10) Patent No.: US 11,668,023 B1
(45) Date of Patent: Jun. 6, 2023

(54) SELF BLOOMING SUPEROMNIPHOBIC MULTIFUNCTIONAL FIBERS AND FABRICS

(71) Applicant: U.S. Government as Represented by the Secretary of the Army, Natick, MA (US)

(72) Inventor: Quoc T Truong, Hyde Park, MA (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 17/721,400

(22) Filed: Apr. 15, 2022

Related U.S. Application Data

(63) Continuation of application No. 16/188,396, filed on Nov. 13, 2018, now abandoned.

(51) Int. Cl.

| | |
|---|---|
| ***D01D 5/253*** | (2006.01) |
| ***D01F 8/10*** | (2006.01) |
| ***D01F 8/06*** | (2006.01) |
| ***D01D 10/02*** | (2006.01) |

(52) U.S. Cl.
CPC ..... *D01D 5/253* (2013.01); *D01D 10/02* (2013.01); *D01F 8/06* (2013.01); *D01F 8/10* (2013.01); *D10B 2321/022* (2013.01); *D10B 2321/06* (2013.01); *D10B 2401/021* (2013.01)

(58) Field of Classification Search
CPC ..... D01F 8/00; D01F 8/04; D01F 8/06; D01F 8/10; D01D 5/253; D01D 10/02; D10B 2321/022; D10B 2321/06; D10B 2401/021
USPC ..... 428/364, 397–400, 372; 977/773, 779
See application file for complete search history.

(56) References Cited

U.S. PATENT DOCUMENTS

| | | | | |
|---|---|---|---|---|
| 2007/0270068 | A1* | 11/2007 | Luo | D21F 7/08 442/337 |
| 2011/0003144 | A1* | 1/2011 | Brown | D01D 5/253 428/332 |
| 2017/0226347 | A1* | 8/2017 | Jin | D06M 11/44 |
| 2018/0023231 | A1* | 1/2018 | Pai | D06M 23/08 442/335 |

* cited by examiner

*Primary Examiner* — Matthew D Matzek
(74) *Attorney, Agent, or Firm* — Eric B. Compton

(57) ABSTRACT

The disclosed subject matter relates to a superomniphobic fiber including a core having a surface and at least one channel and a plurality of nanoparticles disposed in the material core at least partially protruding from the surface of the material core.

8 Claims, 4 Drawing Sheets

SELF BLOOMING SUPEROMNIPHOBIC MULTIFUNCTIONAL FIBERS AND FABRICS

FIELD OF THE INVENTION

This invention relates to self-cleaning and enhanced chemical/biological (CB) protective clothing, the fibers and fabric used to make the clothing and nanoparticles related thereto.

BACKGROUND

Soldiers cannot avoid getting their uniforms dirty while carrying out their missions, especially on the battlefield. Activities such as maneuvering through muddy terrains or dusty battlefields, and oil-contaminated environment make their clothing dirty. Keeping soldier uniforms clean becomes a lower priority, but it's a capability that still needs to be maintained. To remove dirt and/or contaminants from their clothing, enzymatic, surface active, and/or oil-dissolving detergents are needed. Furthermore, it is necessary to keep the soldiers safe from exposure to wet and cold weather, and in a CB contaminated environment.

Resist wetting by low surface tension liquids has been a difficult technical challenge to overcome as well as protecting living creatures (e.g., human beings or animals) from contact with freezing, hot, or viral/bacterial infected water, harmful battlefield and even common household chemicals, petroleum, oils, and lubricants (POLs); and deadly chemical warfare agents (CWAs).

Application of Quarpel DWR onto clothing utilizes perfluorooctanoic acid (PFOA) that is known as "C8 chemistry" in a coating process. C8 chemistry was banned by EPA in favor of a perfluorohexanoic acid (PFHA) or "C6 chemistry" based repellent/finish which is deemed as being more environmentally friendly. The Ultra EverShield® coating has been marketed since Dec. 2013[13] because its C6-based product that is much more durable and repellent to oil and organic solvents as compared to the Quarpel DWR treatment.[14] However, it is expected that EPA may go further to eliminate the use of C6 chemistry since both C8 and C6 chemistries contain fluorine, which has been known to be hazardous to the environment and humans. The coatings industry has gone through many attempts to reformulate and meet the same performance for C6 chemistry-based formulations; however, as things get more stringent, it will necessitate further fluorine-free innovation. Therefore, there may be an effort to minimize the use of fluorine-based coatings/solvents further. However, both, the military and civilian population still have a need to have a capability for gloves, boots, besides other textile-based products to repel against rain, water, POLs, household chemicals, toxic industrial chemicals (TICs), as well as battlefield contaminants and CWAs.

It would be desirable to provide clothing, fibers and fabrics made the fibers that remains clean, comfortable, odor-free, and substantially maintenance-free, without the need to be laundered. Specifically, it would be desirable to create a highly durable, engineered superomniphobic (i.e., superhydrophobic and superoleophobic) fiber with a reentrant fiber structure that will resist dirt, dust, bacterial/viral growth, and wetting by liquids range from water, cooking oil, to very low surface tension liquids.

BRIEF DESCRIPTION

In one embodiment, a self-blooming (SB) superomniphobic fiber is provided. The SB superomniphobic fiber includes fluorinated nanoparticles that naturally seek to migrate onto the surface of the fiber during the final processing stage, a minor water-soluble component, and a major water-insoluble component.

In another embodiment, a process to create SB superomniphobic fiber is provided. The process includes the use of a pilot-scale LBNX fiber extruder or a commercial fiber spinning equipment and a polymer formulation that includes a water-soluble polymer [specifically Nichigo G Polymer™ OKS-9070P, or OKS-8042P Grade, which has a low melting point of 178° C. and melt flow rate of 20 g/10 min], a water-insoluble polymer (e.g., nylon, polyester, or preferably low surface tension polymers), dispersant, and fluorinated nanoparticles.

In another embodiment, a superomniphobic fiber is provided. The superomniphobic fiber includes a core having a surface and at least one channel and a plurality of nanoparticles disposed in the core at least partially protruding from the surface of the core.

In another embodiment, a superomniphobic fiber is provided. The superomniphobic fiber includes a polymer core having a surface and at least one channel along the axis of the polymer core and positioned adjacent to the perimeter of the polymer core and a plurality of nanoparticles disposed in the polymer core at least partially protruding from the surface of the at least one channel of the polymer core.

In another embodiment, a method of producing a superomniphobic fiber is provided. The method includes forming a fiber including a core of a major material component having a plurality of nanoparticles and at least one minor material component disposed at the perimeter of the fiber and along the length thereof wherein the minor component material is removeable, removing at least one minor material component to create reentrant features disposed at the perimeter of the fiber (including inside the micro-channels) and along the lengths of the fiber and self-blooming the nanoparticles to at least partially protrude from the surface of the fiber.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Aspects of the present disclosure include fibers (also may be referred to as filaments), including, for example, superomniphobic fibers that have a channel (e.g., a micro-channel), preferably a plurality of channels (e.g., micro-channels)

along the length of the fiber, and the nanofeatures (e.g., nanoparticles) created on and at least partially protruding from the surface of the fiber and in the channels (e.g., micro-channels), preferably by blooming nanoparticles' migration on the fibers' surfaces. The micro-channel can preferably be along the length of the fiber.

Other aspects of the present disclosure include fabrics made of the fiber of the present disclosure (e.g., by weaving the fibers) and clothing made of the fabric that include the fiber of the present disclosure.

Still other aspects of the present disclosure include methods of forming the fibers of the present disclosure including extruding, including, for example, spinning extruding fibers including a core portion of a major material component (e.g., a water-insoluble material) including nanofeatures (e.g., nanoparticles) and portions of a minor material component that is dissolvable, for example, a dissolvable material (e.g., a water-soluble material), removing the dissolvable minor material component to form a channel (e.g., a micro-channel) in the core portion and causing the nanofeatures, for example, nanoparticles in the core portion to migrate to the surface of the water-insoluble material (e.g., blooming the nanofeatures to the fiber's surface) to at least partially exposing the nanofeatures on the surface of the core portion, preferably in the channel (e.g., micro-channel).

Figure 1:
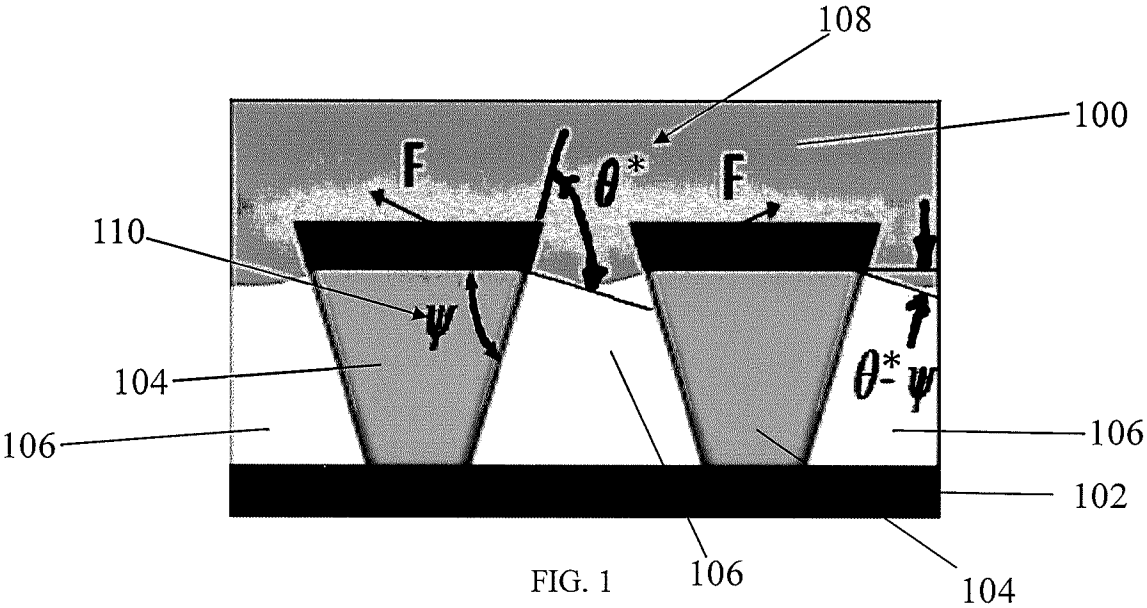
FIG. 1 is a schematic illustration of local surface curvatures.

Local surface curvature is illustrated in the embodiment shown in FIG. 1. In FIG. 1, a liquid 100 is resting on a surface 102. Surface 102 includes pillars 104 with spaces 106 in between pillars 104, with pillars being substantially inverse trapezoidal in shape. Angle θ* 108 is defined as apparent contact angle and angle Ψ 110 is defined as pillar's trapezoidal (or slanted) angle. If angle θ* 108 is greater than angle Ψ 110, as shown in FIG. 1, the net force is directed upward. In this case the liquid-vapor interface recedes to the top of the pillars, creating a composite solid-liquid-air (within the pillars) interface. Thus, the surface allows for the possibility of forming a composite interface provided angle θ* 108 is greater than angle Ψ 110, while any liquid for which angle θ* 108 is less than angle Ψ 110 will produce a substantially wetted interface where liquid will fill and wet the interior surfaces of the pillars.

Figure 2A:
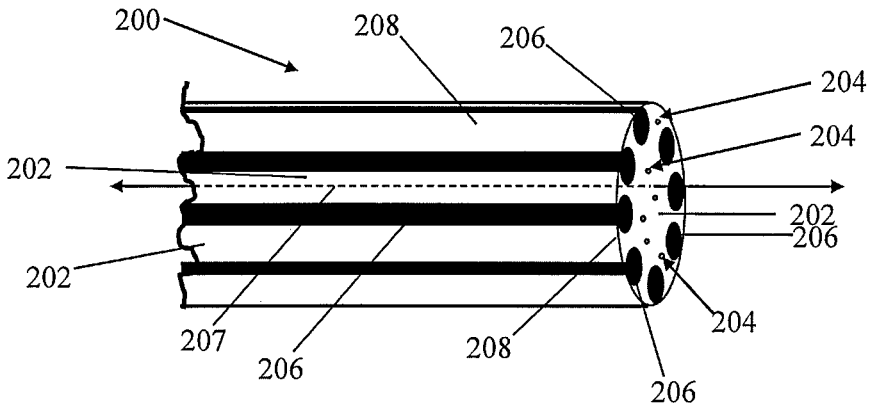
FIG. 2A is a perspective view of one embodiment of the present disclosure.
Figure 2B:
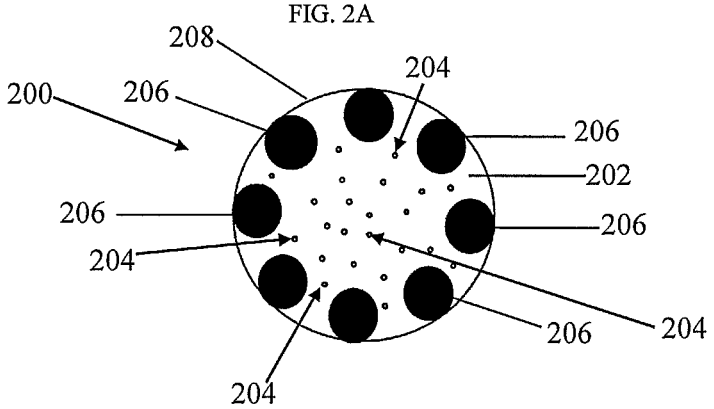
FIG. 2B is a cross-section view of the embodiment of FIG. 2A.

Aspects of another embodiment includes a method used to form the embodiments included herein, including superomniphobic fibers. The method includes forming a multi-component fiber, for example a bi-component fiber, a tri-component fiber, etc., including at least two different materials, for example different polymer material, one material that will be a major component and another material that will be a minor component that will be removed during the process to form reentrant features (e.g., channels) in the fiber. An embodiment of the multi-component fiber is illustrated in FIGS. 2A and 2B. FIGS. 2A and 2B include a multi-component fiber 200 having a core of a major material component 202 that can include a water-insoluble material, for example, a water-insoluble polymer material, the major material component 202 also including nanoparticles 204 (the small circles in the figures) and a minor material component 206 (the large black filled in linear and elliptical shaped sections in FIG. 2A and large black filled in circular sections in FIG. 2B) that is dissolvable and can include a water-soluble material, for example, a water-soluble polymer material. The number of nanoparticles shown in the figure is not indicative of the number in an actual embodiment. Although the embodiment of FIGS. 2A and 2B includes eight portions of the minor material component 206, there may be a few as about 4 portions of minor material component, for example, water-soluble material and as many as about 16 to about 32 portions of the minor material component 206, preferably about 4 to about 16, where each portion of the minor material component 206 can be in a substantially linear configuration along the axis 207 of the fiber 200 and may be located adjacent to the perimeter 208 of fiber 200, the portions preferably about evenly distributed around the perimeter 208. The cross-sectional shape of the minor material component 206 can be substantially circular, as shown in the figure, but can also be other shapes, such as, for example, substantially cylindrical and substantially inversed trapezoidal. The cross-sectional shape of the core of a major material component 202 can be substantially circular, as shown in the figure, but can also be other shapes, such as, for example, substantially elliptical or substantially octagonal. Fiber 200 can be formed using, for example, a polymer melt of the major material component (e.g., water-insoluble polymer material) with nanoparticles and, separately a polymer melt of the minor material component (e.g., water-soluble polymer material). The polymer melt of the major material component with nanoparticles and the polymer melt of the water-soluble material can then be sent to a die configured to extrude each in the desired pattern, such as that included in the embodiment of FIGS. 2A and 2B, using, for example, a spin pack and an LBNX extruder. The extruded fiber of FIG. 22A and 2B may then be cooled, for example air cooled, to a temperature ranging from about 28° C. to about 23° C., before proceeding to the next step.

The diameter of substantially circular or elliptical shape of the fiber can range from about 30 μm to about 150 μm. The diameter of each of the substantially circular in cross-section shape of the minor material component 206 can range from about 3 μm to about 15 μm, depending on the diameter of the fiber and the number of portions of the minor material component disposed therein.

An LBNX extruder was used to form embodiments of the present disclosure under the following conditions, capacity −1.1 to 2.2 pounds/hour; 19 filament melt extrusion; ⅝ Inch diameter single screw; extruder temperature limit: 450° C.; godet temperature limit: 180° C.; corrosion resistant extruder, spin head & filament pack; meltblown and spunbond non-woven capabilities; web collector and belt conveyor; 3" wide heated calendar for spunbond; godet speeds: 200-2000 m/min; and winder speed: 500-2500 m/min.

The major material component can be water-insoluble material including a water-insoluble polymer, preferably a water-insoluble low surface energy polymer, including, for example, polypropylene, nylon, polyurethane, melt-processable rubber (e.g. Alcryn®), fluoroelastomers (e.g., Technoflon®), melt-processable fluorinated compounds that have excellent chemical resistance, toughness and lubricity (e.g., Fluon® copolymer resins such as fluorinated ethylene propylene (FEP), ethylene tetrafluoroethylene (ETFE), perfluoroalkoxy (PFA), polyvinylidene fluoride (PVDF), etc.), preferably polypropylene, and melt-processable fluorinated polymers. A low surface energy polymer means a polymer that has a surface which resists wetting by low surface tension liquids. The weight percent of the water-insoluble material can range from about 50 wt % to about 80 wt % as compared to that of the water-soluble material. Preferably solid polymer pellets are used and feed into the extruder (preferably, a twin-screw extruder) for melting using, for example, a hopper that feeds the pellets into the extruder.

The nanoparticles can be, for example, made of fluorinated silica, that includes silica nanoparticles treated with fluorinated polymer coatings (e.g., (polydimethyl siloxane (PDMS), Tecnoflon®, EverShield®, Teflon™ FEP, etc.).

The nanoparticles density can range from about 0.1 g/cm$^3$ to about 2.5 g/cm$^3$, with the size ranging from about 20 nm to about 500 nm (or about 0.5 μm). The size of the nanoparticles may be of a suitable size and weight to self-bloom as described below and also not be of a size large enough upon self-blooming to completely block the reentrant channels formed in the fiber once they have self-bloomed on the surface of the fiber. The weight percent of the nanoparticles in the water insoluble material can range from about 0.5 wt % (or about 0.5 g of nanoparticles/100 g water-insoluble polymer) to about 5.5 wt % (or about 5.5 g of NP/100 g of water-insoluble polymer).

The minor material component can be a water-soluble material including a water-soluble polymer, for example, polyvinyl alcohol, polysaccharides, polyethylene oxide, starch, preferably polyvinyl alcohol. The weight percent of the water-soluble material can range from about 20 wt % to about 50 wt %. Preferably solid polymer pellets are used and feed into the extruder (preferably, a twin-screw extruder) for melting using, for example, a hopper that feeds the pellets into the extruder.

Figure 3A:
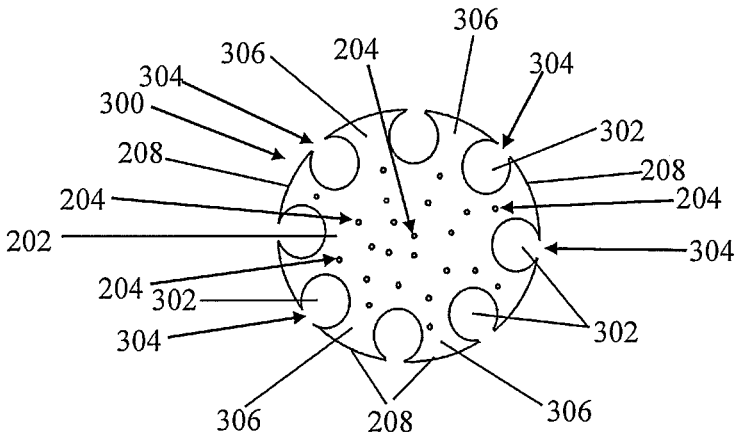
FIG. 3A is a cross-section view of another embodiment of the present disclosure.
Figure 3B:
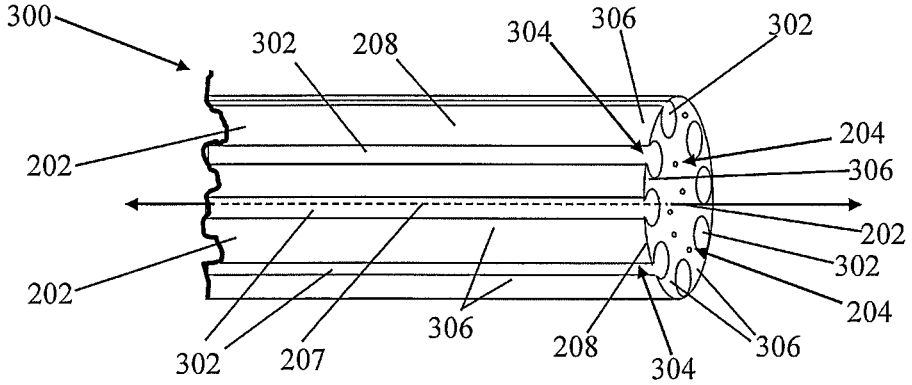
FIG. 3B is a perspective view of the embodiment of FIG. 3A.

The process proceeds with subjecting the embodiment of FIGS. 2A and 2B to remove or dissolve the minor component material using, for example, an aqueous environment where the minor component material is a water-soluble material 206 (e.g., a water-soluble polymer material) to form the embodiment of FIGS. 3A and 3B. FIGS. 3A and 3B include fiber 300 having the core of major component material 202 including nanoparticles 204 and eight channels 302 that are formed when the minor component material 206 was removed or extracted from the fiber leaving the channels 302 in its place (e.g. in a substantially linear configuration along the axis 207 of the fiber 300 and located adjacent to the perimeter of fiber 300) having substantially the same shape as the minor component material 206 that was removed or dissolved. The number of channels is dependent on the number of portions of the minor material component 206 present before the removal or dissolving step above. Where the minor component material is a water-soluble material, the removal or extraction of the minor component material 206 can take place in, for example, an extraction tank that contains circulating water at an elevated temperature, such as ranging in temperature from about 27° C. to about 38° C., depending on the water-soluble material used and the amount of time can take from about 5 seconds to about 30 seconds depending on the pull speed of moving the fiber or fiber based fabric through the water extraction assembly. Channels 302 each have an opening 304 positioned along the length of the channel. The major component material 202 includes pillars 306 positioned between adjacent channels that may have a substantially inverse trapezoidal shape so as to have the benefits of local surface curvature is illustrated in the embodiment shown in FIG. 1. The number of nanoparticles shown in the figure is not indicative of the number in an actual embodiment. Pillars 306 can be in a substantially linear configuration along the axis 207 of the fiber 300 and located adjacent to the perimeter 208 of fiber 300. As a result, fiber 300 can have a reentrant fiber structure due to the substantially inverse trapezoidal of pillars 306 that minimizes the capillary effect and substantially keeps water out of the channels. Although the embodiment of FIG. 3 includes eight pillars 306, there may be a few as about 4 pillars and as many as about 16 or more, preferably from about 4 to about 16 where pillars 306 can be in a substantially linear configuration along the axis 207 of the fiber 300 and may be located adjacent to the perimeter 208 of fiber 300, the pillars preferably about evenly distributed around the perimeter 208.

Figure 4A:
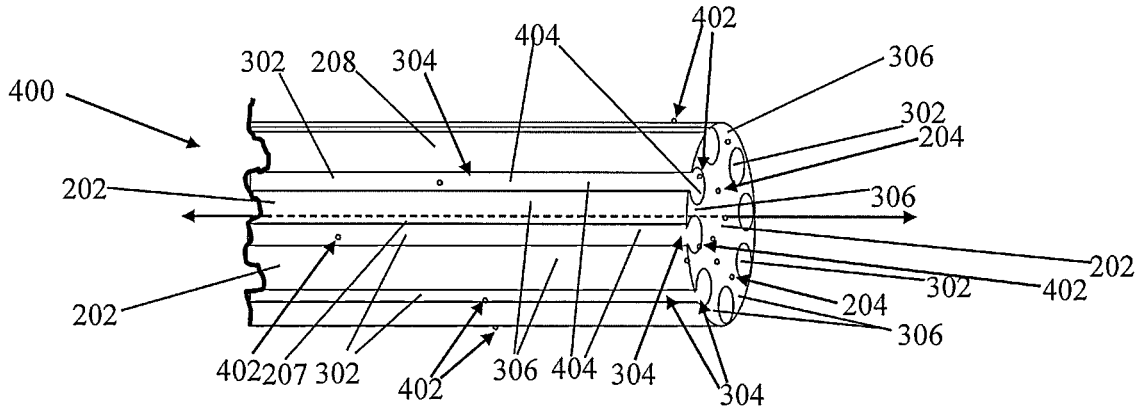
FIG. 4A is a perspective view of another embodiment of the present disclosure.
Figure 4B:
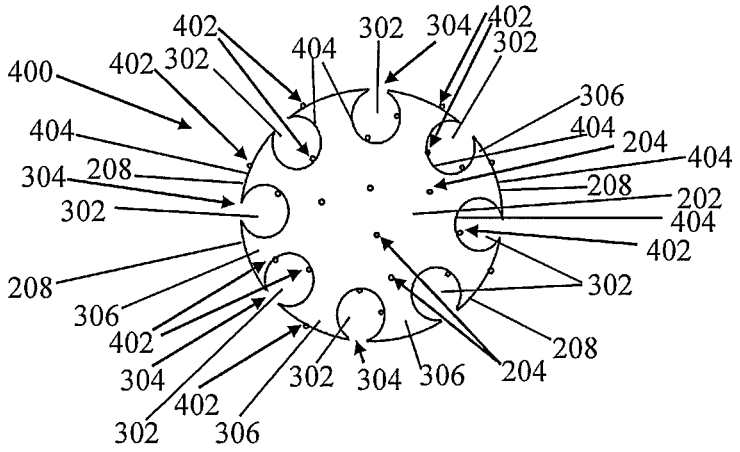
FIG. 4B is a cross-section view of the embodiment of FIG. 4A.

The process proceeds with subjecting the embodiment of FIGS. 3A and 3B to fiber conditioning at an elevated temperature to cause the self-blooming of the nanoparticles within the fiber to migrate through the major component material to the surface of the fiber to form the embodiment of FIGS. 4A and 4B. FIGS. 4A and 4B include fiber 400 having the core of major component material 202 that may include some nanoparticles 204 and channels 302. FIGS. 4A and 4B also includes self-blooming nanoparticles 402 that were in major component material 202 in FIGS. 3A and 3B, but have migrated through major component material 202 to at least partially protrudes through the fiber surface 404. The elevated temperature for the self-blooming process can range in temperature of from about 80° C. to about 90° C. for about 3 to about 15 seconds (or more) using, for example, infrared radiation to cause the migration of fluorinated nanoparticles to the fiber surface, depending on the major component material and nanoparticle composition used and may take place in a heating space, for example, in an IR oven. The amount of time for the self-blooming process in an IR oven can take from about 3 seconds to about 15 seconds. The number of nanoparticles shown in the figure (within the core or self-bloomed through the surface) is not indicative of the number in an actual embodiment. The portion of nanoparticles in the embodiment of FIGS. 3A and 3B that bloom to the surface in the embodiment of FIGS. 4A and 4B can range from about 0.5 wt % to about 5.5 wt %, preferably from about 4.5 wt % to about 5.5 wt %. The resulting embodiment of FIGS. 4A and 4B is a superomniphobic fiber. During this step, the nanoparticles have a lower surface tension than air bubbles that may be present in the water-insoluble material and, as a result, move to the surface of the water-insoluble material. The nanoparticles in the surface of the fiber, particularly on the surface of the fiber in the channels can keep liquid localized in the channel rather than allowing the liquid to flow therethrough.

The embodiment of FIGS. 4A and 4B may then be collected by, for example, winding it on a spool.

Once the superomniphobic fiber is created, sufficient fiber can be spun, yarns can be created (twisted together) using the superomniphobic fibers with, for example, additional superomniphobic treated Kevlar yarns (or similar yarns that can be made of an abrasion resistant polymer) to increase abrasion resistance in the final fabric form. The fabrics formed therefrom can be tailored into self-cleaning and enhanced chemical/biological (CB) protective clothing, including, for example, coats, jackets, pullover tops, pants, foot ware, gloves, hats, hoods, socks, etc. Fabric samples up to 8" wide can be woven using, for example, NSRDEC's hand loom weaving equipment. The resulting fabric will be highly durable, long lasting, and will maintain its superomniphobicity because each individual fiber will have its own super nonwetting fiber structure. As the outer yarn layers (which are bundles made up of hundreds of superomniphobic fibers) are abraded away, the subsequent internal layers of fibers will still be able to provide their super nonwetting performance. The superomniphobic fibers can have a special super nonwetting performance characteristic that will outperform liquid repellent surface treated fibers/textiles as the coated fibers/textiles are easily be abraded away.

Creating micrometer scale trapezoidal feature that will run along the length of a fiber and around its circumference can create a reentrant architecture to prevent liquid wetting into the fiber's micrometer size channels. Furthermore, the low-surface energy core polymer which can be used to create the reentrant fiber structure also contain blooming nanometer-scale particles. At an elevated temperature, these blooming nanoparticles will migrate onto the surface of the fiber, effectively creating a $3^{rd}$ level reentrant surface features that resemble a pimple-filled surface, with the $1^{st}$ and $2^{nd}$ level reentrant surface features include single fiber size, and fiber bundle size and fabric weave structure geometry respectively, and the microchannels along the fiber length being the $4^{th}$ level reentrant surface feature. This pimple-filled surface will effectively prevent the capillary effect that could move liquid inside the micro-channels that surround and run along the fiber length. Without these "pimple-like" nanofeatures, a sufficiently low surface tension liquid under certain hydrostatic pressure will wet the reentrant fiber core's micro-channels and will likely move the liquid along the fiber length. When this occurs, the fabric surface will be wet, and liquid will also wet through the fabric structure. In addition, the feasibility of adding antimicrobial additives such as the polycyclic antibacterial peptide nisin—a rare broad spectrum bacteriocin that is effective against many Gram-positive organisms[10] and polyphosphazene flame retardant can be optionally used as well depending on their compatibility to the core fiber's polymer, and the resulting superomniphobic fiber could also retard the bacterial/viral growth and flame propagation.

This written description uses examples as part of the disclosure, including the best mode, and also to enable any person skilled in the art to practice the disclosed implementations, including making and using any devices or systems and performing any incorporated methods. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A superomniphobic fiber, comprising:

a. a core having a circular or elliptical cross-sectional shape, a first diameter, a longitudinal length and a surface and at least one pair of channels wherein each channel has a substantially circular cross-sectional shape extending along the length of the core and wherein each channel has a second diameter, wherein the first diameter ranges from about 30 μm to about 150 μm and the second diameter ranges from about 3 μm to about 15 μm, and including openings of the channels that are less than a diameter of the circular cross-section of each channel whereby a pillar is formed between each pair of channels having an inverse trapezoidal cross sectional shape and defining a trapezoidal angle in a direction extending from a longitudinal axis of the fiber and being defined by the second diameter range relative to the first diameter range, wherein the trapezoidal angle is greater than a contact angle defined between a tangent to a surface of the fiber and the surface of the fiber itself to thereby minimize wettability of the fiber; and b. a plurality of nanoparticles disposed in the core at least partially protruding from the surface of the core.

2. The superomniphobic fiber of claim 1, wherein the material core is a polymer.

3. The superomniphobic fiber of claim 1, wherein the polymer is polypropylene.

4. The superomniphobic fiber of claim 1, wherein the plurality of nanoparticles disposed in the core are at least partially protruding from the surface of the at least one channel.

5. The superomniphobic fiber of claim 1, wherein the number of channels ranges from about 4 to about 16.

6. The superomniphobic fiber of claim 1, wherein the core includes 8 channels.

7. The superomniphobic fiber of claim 1, wherein the at least one pair of channels are each substantially linear in configuration, extend parallel to the axis of the core and are positioned about the perimeter of the core.

8. The superomniphobic fiber of claim 1, wherein the size of each nanoparticle of the plurality of nanoparticles ranges from about 20 nm to about 500 nm.

* * * * *